US005826507A

United States Patent [19]

Lim

[11] Patent Number: 5,826,507

[45] Date of Patent: Oct. 27, 1998

[54] METHOD FOR MEASURING THE AMOUNT OF FOUNTAIN SOLUTION IN OFFSET LITHOGRAPHY PRINTING

[75] Inventor: Peter Yong Woon Lim, Suffolk, Va.

[73] Assignee: Union Camp Corporation, Wayne, N.J.

[21] Appl. No.: 862,098

[22] Filed: May 22, 1997

[51] Int. Cl.[6] ..... B41F 31/00

[52] U.S. Cl. ..... 101/350.1; 101/DIG. 45

[58] Field of Search ..... 101/DIG. 45, 350.1, 101/350.2, 350.3, 350.4, 350.5, 350.6, 351.1, 351.2, 351.3, 351.4; 73/53.01, 64.41; 422/68.1; 436/56

[56] References Cited

U.S. PATENT DOCUMENTS

| | | | |
|---|---|---|---|
| 4,722,274 | 2/1988 | Jeschke et al. | 101/148 |
| 4,972,774 | 11/1990 | MacPhee | 101/450.1 |
| 5,090,316 | 2/1992 | Rodi et al. | 101/148 |
| 5,181,467 | 1/1993 | Takekoshi | 101/147 |
| 5,202,265 | 4/1993 | LaMora | 436/56 |
| 5,209,160 | 5/1993 | Smith | 101/148 |
| 5,256,190 | 10/1993 | Barth | 101/148 |
| 5,329,850 | 7/1994 | Duarte | 101/148 |
| 5,341,734 | 8/1994 | Jeschke et al. | 101/148 |
| 5,368,817 | 11/1994 | Sudo et al. | 422/62 |
| 5,426,509 | 6/1995 | Peplinski | 356/430 |
| 5,450,190 | 9/1995 | Schwartz et al. | 356/71 |

*Primary Examiner*—Edgar Burr
*Assistant Examiner*—Daniel J. Colilla
*Attorney, Agent, or Firm*—Watov & Kipnes, P.C.

[57] ABSTRACT

A method of determining the amount of a fountain solution employed in an offset lithography printing system in which a detectable substance is added to the fountain solution and the amount thereof detected in a target such as the ink rollers and/or the image and non-image areas of the printed paper, the amount of the detectable substance being related to the amount of fountain solution employed in the offset lithography process.

17 Claims, 1 Drawing Sheet

METHOD FOR MEASURING THE AMOUNT OF FOUNTAIN SOLUTION IN OFFSET LITHOGRAPHY PRINTING

TECHNICAL FIELD

The present invention is directed to offset lithography printing methods employing a fountain solution in which the amount of fountain solution employed in the system is quantitatively determined through the use of at least one detectable substance such as lithium chloride.

BACKGROUND OF THE INVENTION

The process of offset lithography employs the application of ink to an imaging plate rather than directly to the paper which is to receive the image. The ink applied to the imaging plate forms an image which is transferred to a blanket cylinder. It is the blanket cylinder which comes into contact with the paper. The printing plate is comprised of image areas and non-image or non-printing areas, and the distinction between them is maintained chemically on the surface of the imaging plate.

When the printing plate is made, the printing image is made hydrophobic and the non-printing areas are made hydrophilic. The plate is mounted on the plate cylinder of the press and comes into contact respectively with rollers wet by a fountain solution and rollers wet by ink. The fountain solution wets the non-printing areas of the plate and prevents ink from wetting these areas. The ink wets the image areas which are transferred to the blanket cylinder. The ink image is transferred to the paper from the blanket cylinder.

As indicated above, the fountain solution repels ink on the plate to maintain a certain area as a non-image area. The fountain solution typically comprises water, a natural or synthetic gum and other chemicals used to dampen the plate and keep non-printing areas from accepting ink.

The amount of fountain solution which is present on the printing plate is a critical part of offset lithography methods in order to maintain sharp and clear images. For example, if insufficient fountain solution is provided to the non-image area, the ink will invade the non-image area to create a distorted printing image. Conversely, if too much fountain solution is provided so that the fountain solution enters the image area, a distortion of the image will also result.

In addition, the amount of the fountain solution added to the paper increases the total moisture content of the paper. In a combined printing operation including offset preprinting followed by electronic printing (e.g. laser printing or ion beam printing), the moisture content of the paper is an important variable in controlling the quality of the printed image, particularly an electronically printed image. For example, in electronic printing a toner is used to form the printed image. In the imaging process, the surface resistivity of the toner is a function of the moisture content of the paper. If the moisture content is too low the surface resistivity increases, allowing static electricity to develop in the paper which causes the paper to stick or jam during printing. Accordingly, the paper does not properly separate from the imaging drum. If the moisture content is too high, the resistivity declines causing the toner to inadequately stick to the paper.

Thus, the moisture content of the paper is an important variable in obtaining high quality printed images. Since the concentration of the fountain solution in the printed paper is related to the moisture content of the paper, knowing the concentration of the fountain solution in the printed paper with a high degree of certainty will provide the means for controlling the moisture content of the paper.

The amount of fountain solution which is applied to the printing plates is therefore critical to the production of clear printed images. Currently, the amount of fountain solution which is applied to the plates used in offset lithography is based principally on the experience of the offset press operator. There is to date no accurate method of quantifying the amount of fountain solution used in offset lithography printing processes so as to minimize the undesirable effects of too much or too little fountain solution.

It would therefore be a significant advance in the art of offset lithography if the amount of fountain solution which is used in the printing process could be quantified without disrupting the operation of the printing process. It would be a further advance in the art if a method could be developed for accurately determining the moisture content of the paper to thereby regulate surface resistivity.

SUMMARY OF THE INVENTION

The present invention is generally directed to a method of quantitatively detecting the amount of fountain solution which is employed in an offset lithography process, and especially to accurately determine and control the amount of fountain solution which is applied to the ink applying rollers and/or to the paper both in the image and non-image areas.

More specifically, the present invention is directed to a method of determining the amount of a fountain solution employed in an offset lithography printing system comprising:

a) adding a detectable quantity of at least one detectable substance into the fountain solution;

b) transferring a portion of the fountain solution to at least one target selected from ink rollers and the image and non-image areas of a printed paper;

c) measuring the amount of said detectable substance in said at least one target; and d) determining the amount of fountain solution in said at least one target as a function of the amount of the detectable substance measured in said at least one target.

BRIEF DESCRIPTION OF THE DRAWING

The following drawing is submitted to illustrate an embodiment of the invention and is not intended to limit the invention as encompassed by the claims forming part of the application.

DETAILED DESCRIPTION OF THE INVENTION

Figure 1:
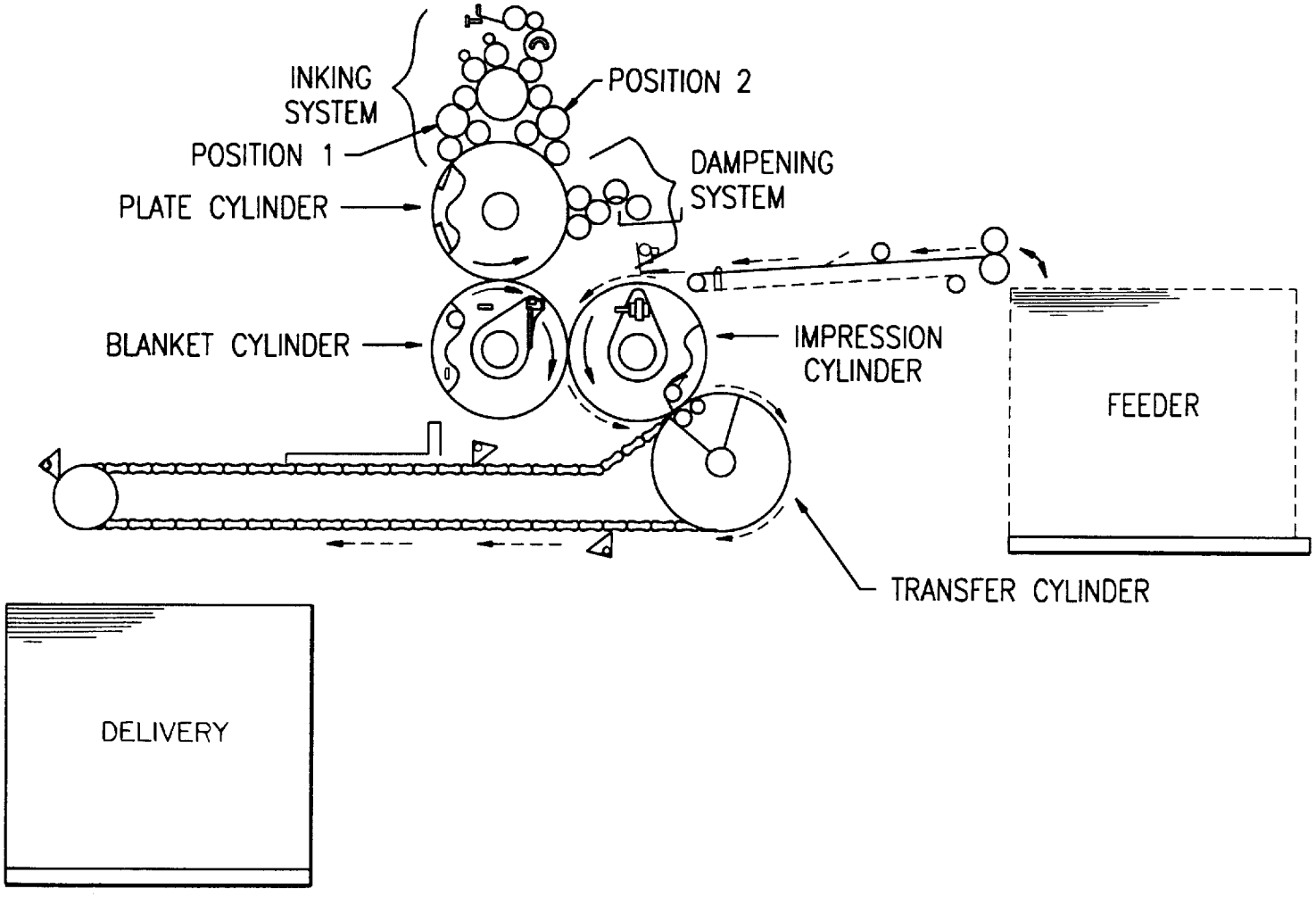
FIG. 1 is a schematic view of an ink roller assembly of a printing press showing the location of samples of ink and fountain solution used in Example 2 herein.

The present invention is generally directed to a method of determining the amount of a fountain solution which is used during offset lithography. The fountain solution plays a key role in offset printing. It has been a difficult task to measure quantitatively the amount of the fountain solution which is employed in offset lithography such as the amount picked up by the ink rollers or by the printed paper.

There are two principal reasons why it is difficult to measure the amount of fountain solution. First, the amount of fountain solution picked up by the ink rollers and paper is very small; therefore, any system which relies on gravimetric (i.e. weight difference) methods is not accurate enough to provide the operator with reliable information.

Second, the fountain solution travels over a roller assembly including multiple rollers. In particular, the roller assembly comprises a plate cylinder or roller which is treated with inking rollers and dampening rollers (containing a fountain solution to form image and non-image areas). The plate cylinder contacts a blanket cylinder rotating in the opposite direction to the plate cylinder. As a result, the image to be printed is formed on the blanket cylinder.

The blanket cylinder is positioned in proximity to an impression cylinder such that a sheet of paper passing between the blanket cylinder and the impression cylinder is imprinted with the image formed on the blanket cylinder.

Evaporation of the fountain solution takes place during processing using a multi-roller assembly and also from the surface of the plate. It is therefore difficult to accurately determine the amount of the fountain solution which has been transferred to the paper.

In accordance with the present invention, a detectable substance is added to the fountain solution. The term "detectable substance" as used herein shall mean any substance that can be incorporated into the fountain solution and be picked up in the image and non-image areas of the printed paper, especially the non-image areas. The detectable substance preferably remains stable within the fountain solution which means that the detectable substance does not undergo chemical change to another substance. In addition, the detectable substance must be capable of detection in the fountain solution in small quantities. Still further, it is preferred that the detectable substance be a substance which is not normally or inherently present in the target (i.e. the ink rollers and/or the printed paper). In this way, the amount of the detectable substance which is detected corresponds to the amount obtained directly from the fountain solution. It will be understood, however, that substances contained within the target may also be used as the detectable substance. In this event, the amount of the detectable substance normally found in the target must be determined and subtracted from the total amount of the detectable substance present in the target after contact with the fountain solution. The net result is the amount of the detectable substance obtained from the fountain solution.

The preferred detectable substances are selected from the group consisting of metal salts, isotopes and organic compounds. The preferred class of detectable substances is water soluble metal salts.

The metal salts are preferably water soluble metal salts which are not generally present in ink rollers and/or paper used for printing. Preferred metal salts therefore include metal salts of lithium, magnesium, manganese, zinc, aluminum and the like. Preferred metal salts are inorganic lithium compounds such as lithium chloride, lithium nitrate, lithium sulfate and the like. Organic salts of lithium can also be used such as lithium acetate, lithium ethylate, lithium propionate, lithium carboxylate and the like. Preferred isotopes include deuterium and $C^{13}$ which can be detected, for example by mass spectrometry. The preferred organic compounds are those that can be preferably determined by gas chromatography and gas chromatography/mass spectrometry such as naphthalene propionic acid and naphthalene ethanoic acid.

The detectable substance is added to the fountain solution in a specified concentration. The concentration of the detectable substance must be an effective concentration to enable the detectable substance to be readily detected in the offset lithography process where fountain solution is found (i.e. in the ink roller and/or in the printed paper). A preferred concentration of the metal salts (e.g. lithium chloride) in the fountain solution is at least 0.1% by weight, preferably in the range of from about 1.0 to 5.0% by weight, most preferably from about 1.0 to 3.0% by weight. It will be understood that the concentration of the detectable substance can vary depending on the detectable substance that is used.

In operation of the present process, a fountain solution is prepared having a desirable concentration (e.g. from about 1 to 3% by weight for metal salts) of the detectable substance. The offset lithography process is conducted with fountain solution being deposited on the non-image areas of the lithographic plates and then being contacted by the roller assembly which in turn contacts the paper so that fountain solution is found principally in non-image areas of the paper. To determine the amount of fountain solution which has been consumed, a sample of the printed paper is tested to determine the amount of the detectable substance which is found in the printed paper. The amount of the detectable substance can be correlated to the amount of fountain solution which has been consumed because the concentration of the detectable substance in the fountain solution is accurately known.

In addition, or alternatively, fountain solution can be detected in the ink rollers. The employment of the detectable substance as defined herein enables the detection of the substance as a function of the amount of fountain solution contained in the ink rollers.

The manner in which the detectable substance is detected will vary depending on the detectable substance. Atomic absorption spectrometry is especially suitable for detecting metal salts in the fountain solution although other methods (e.g. flame photometry) can be used and would be apparent to those of ordinary skill in the art. As previously indicated, isotopes can be detected, for example, by mass spectrometry while organic compounds can be detected, for example, by gas chromatography or gas chromatography/mass spectrometry.

The following examples are illustrative of embodiments of the invention and are not intended to limit the invention as encompassed by the claims forming part of the application.

EXAMPLE 1

1) Printing Setup and Operating Conditions

This experiment was performed using a Komori Lithrone 26, 26" two-color sheetfed offset press with 55# offset paper, 17½"×22½" cut sheets. The press was adjusted for its normal optimum running conditions to obtain a target optical density of 1.2–1.29 except when the fountain solution flow rate was deliberately varied for experimental purposes.

The fountain solution was circulated at a constant rate. The top surface level of the reservoir was marked at the beginning of each run and the solution was added to bring the level to the original mark at the end of each run. The weight of the fountain solution added was accurately measured and recorded for calculating the consumption rate. The press was operated at a constant speed of 8,000 impressions per minute using a black printing ink, specifically SUN CHEMICAL 26509 GENERAL PRINTING INK NATURAL GLO PROCESS BLACK INK.

A fountain solution of the present invention was prepared by dissolving 3 oz. of a known fountain solution, specifically VARN LITHO ETCH 142W per gallon of deionized water. Purified low sodium HFRC 2002 lithium chloride (manufactured by Baker Chemicals) was used to make up a 2% by weight lithium chloride fountain solution. The solution pH was 4.2 and conductivity was 1900 mhos. The average temperature in the press room was 75° F. and the relative humidity was about 20%.

An RIT Test Pattern #528 was used. This is a conventional printing pattern comprised of, for example solid and half-tone stripes, a picture of a human subject and a series of small squares. After reaching a stable printing condition, 10,000 impressions were printed. At the end of each run, the reservoir of the fountain solution was topped to the mark while accurately measuring the weight of the solution used. Samples from the non-image area and image area were analyzed for lithium chloride concentration to determine the amount of the fountain solution picked up.

2. Analytical Determination of the Fountain Solution Picked Up by the Printed Paper The image area and unprinted area were cut out of the printed sheet. The paper sample was cut into 0.5×3 cm strips and 20 strips (about 0.5 gms) were placed in 5 ml of ASTM Type II water in a capped test tube and heated for one hour at 80° C. and left at room temperature for 18 hours. The solution thus extracted was analyzed for lithium content using an Instrumentation Laboratory Model 551 flame atomic absorption spectrometer. An Aldrich brand standard reference solution for lithium was used for comparison.

3. Determination of the Fountain Solution Material Balance

The total consumption of the fountain solution was determined by adding the solution in the reservoir at the end of each run to bring the level to the originally marked position. The amounts of solution picked up by the image area and the non-image area were determined by chemical analysis and the total solution carried by the printed sheet was calculated using basis weight and ream size. The net difference between the total consumption and the amount carried by the printed paper was taken as the loss through evaporation and spillage. The results are shown in Table 1.

TABLE 1

| | |
|---|---|
| Fountain Solution in the Image Area | 0.730% |
| Fountain Solution in the Non-Image Area | 0.0646% |
| Image Area of the Test Pattern (RIT Test Pattern #528) | 32.86% |
| Non-Image Area of the Test Pattern | 67.14% |
| Total Paper Printed | |
| Area | 27,734 $ft^2$ |
| Weight | 455.7 lb. |
| Image Area of the Printed Paper | |
| Area | 8,971 $ft^2$ |
| Weight | 149.7 lb. |
| Non-Image Area of the Printed Paper | |
| Area | 18,621 $ft^2$ |
| Weight | 305.9 lb. |
| Fountain Solution in the Image Area (0.0646%) | 1.0930 lb. |
| Fountain Solution in the Non-Image Area (0.730%) | 0.1976 lb. |
| Total Fountain Solution in the Printed Paper | 1.2907 lb. (885.9 grams) |
| Total Fountain Solution Consumed during the Run | 893.8 grams |
| Fountain Solution Lost due to Evaporation and Handling | 307.9 grams |
| % Fountain Solution Lost | 34.45% |

As shown in Table 1, the present invention provides an effective method of accurately determining the amount of fountain solution which has been consumed during offset printing and the amount of the fountain solution picked up by the printed paper.

EXAMPLE 2

The printing setup described in Example 1 was repeated. The fountain solution employed in this example contained 1.81% by weight of lithium chloride. The fountain solution was measured in the inking rollers in printing positions 1 and 2 as shown in FIG. 1. Position 1 is the ink roller, which is the last roller in contact with the plate cylinder. Position 2 is an intermediate position in the inking roller system and is used to illustrate how the fountain solution is gradually incorporated into the ink to form an emulsion.

Samples of ink were taken at positions 1 and 2 during various stages of the printing process as determined by the number of impression made and the results are shown in Table 2.

TABLE 2

| Number of Impressions | Position 1 | Position 2 |
|---|---|---|
| 1,000 | 27.1%* | |
| 1,500 | | 17.7% |
| 2,500 | 27.1% | |
| 3,000 | | 19.3% |
| 4,000 | 38.7% | |
| 4,500 | | 28.7% |
| 5,300 | 34.8% | |
| 5,700 | | 28.2% |

*% by weight

As shown in Table 2, after about 4,000 impressions the ink and fountain solution reached a steady state. The amount of fountain solution in position 1 exceeded that of position 2 because the latter position is intermediate to the final printing stage as indicated by position 1.

What is claimed is:

1. A method of determining the amount of a fountain solution employed in an offset lithography printing system comprising:

a) adding a detectable quantity of at least one detectable substance into the fountain solution;

b) transferring a portion of the fountain solution to at least one target selected from the group consisting of ink rollers and the image and non-image areas of a printed paper;

c) measuring the amount of said detectable substance in said at least one target; and d) determining the amount of fountain solution in said at least one target as a function of the amount of the detectable substance measured in said at least one target.

2. The method of claim 1 wherein the detectable substance remains stable in the fountain solution.

3. The method of claim 1 wherein the target is said ink rollers.

4. The method of claim 1 wherein the target is the image and non-image areas of the printed paper.

5. The method of claim 1 wherein the detectable substance is not inherently found in the target.

6. The method of claim 1 wherein the detectable substance is selected from the group consisting of metal salts, isotopes, and organic compounds.

7. The method of claim 6 wherein the metal salt is water soluble.

8. The method of claim 7 wherein the metal of the metal salts is selected from the group consisting of lithium, magnesium, manganese, zinc and aluminum.

9. The method of claim 8 wherein the metal salt is an inorganic or organic lithium salt.

10. The method of claim 9 wherein the metal salt is lithium chloride.

11. The method of claim 6 wherein the isotopes are selected from the group consisting of $C^{13}$ and deuterium.

12. The method of claim 6 wherein the organic compounds are selected from the group consisting of naphthalene propionic acid and naphthalene ethanoic acid.

13. The method of claim 1 wherein the step of measuring the amount of the detectable substance comprises obtaining a sample of the fountain solution from the target and passing the sample through an instrument capable of detecting said detectable substance.

14. The method of claim 6 comprising adding to the fountain solution an amount of a metal salt sufficient to form a fountain solution containing at least 0.1% by weight of the metal salt.

15. The method of claim 14 wherein the fountain solution contains up to 5% by weight of the metal salt.

16. The method of claim 1 wherein the fountain solution contains from about 1 to 5% by weight of the metal salt.

17. The method of claim 16 wherein the fountain solution contains from about 1 to 3% by weight of the metal salt.

* * * * *